United States Patent [19]

Loesche

[11] Patent Number: 4,782,986

[45] Date of Patent: Nov. 8, 1988

[54] APPARATUS AND METHODS FOR REMOVING MARGIN PORTIONS FROM PERFORATED FLEXIBLE SHEET MATERIALS

[76] Inventor: Ray Loesche, P.O. Box 3446, Spokane, Wash. 99220

[21] Appl. No.: 12,080

[22] Filed: Feb. 6, 1987

[51] Int. Cl.[4] ..... B26F 3/02

[52] U.S. Cl. ..... 225/1; 225/2; 225/93; 225/106

[58] Field of Search ..... 225/106, 101, 93, 1, 225/2; 83/465, 459, 589, 466.1; 269/161

[56] References Cited

U.S. PATENT DOCUMENTS

| | | | |
|---|---|---|---|
| 117,665 | 8/1871 | Moore | 83/589 |
| 125,204 | 4/1872 | McCullagh . | |
| 442,414 | 12/1890 | Blanchard . | |
| 492,354 | 2/1893 | Harrison . | |
| 568,400 | 9/1896 | Blanchard . | |
| 863,271 | 8/1907 | Fritch et al. . | |
| 867,978 | 10/1907 | Kinkead et al. . | |
| 912,981 | 2/1909 | Graves . | |
| 1,032,359 | 7/1912 | Gibbs . | |
| 1,092,381 | 4/1914 | Neely | 83/589 |
| 1,249,309 | 11/1917 | Bottle . | |
| 1,489,462 | 4/1924 | Schooley . | |
| 1,849,166 | 3/1932 | Adams . | |
| 2,005,355 | 6/1935 | Tierney, Jr. | 83/466.1 |
| 2,579,835 | 12/1951 | Lather | 225/101 |
| 2,711,793 | 6/1955 | Zalkind | 225/101 |
| 2,730,174 | 1/1956 | Weinstein | 225/101 |
| 2,812,567 | 11/1957 | Zalkind | 225/101 |
| 3,190,516 | 6/1965 | Eriksen | 225/101 |
| 4,529,113 | 7/1985 | Elliott | 225/106 X |
| 4,573,383 | 3/1986 | Matsumoto | 83/465 X |
| 4,657,163 | 4/1987 | Cats | 225/106 |

FOREIGN PATENT DOCUMENTS

| | | | |
|---|---|---|---|
| 327469 | 10/1920 | Fed. Rep. of Germany | 83/459 |
| 535054 | 1/1922 | France | 269/161 |

*Primary Examiner*—Frank T. Yost

*Attorney, Agent, or Firm*—Wells, St. John & Roberts

[57] ABSTRACT

Methods and apparatuses for tearing computer printer paper margin pieces from the main part of the paper sheet. The apparatuses include base and operative members having opposing jaws which are controllably movable between open and grasping positions. The jaws are formed with inwardly converging lips which guide the paper stacks into place. A backstop is provided to align the paper with respect to the jaws. An end stop can also be provided. Biasing is provided to open the jaws and a separation limiting structure is used to automatically stop the jaw opening at a predetermined limit. Arched jaw faces are shown for improved gripping of the sheets.

45 Claims, 8 Drawing Sheets

10
12
14
16
18a
18b
20
22
28
34
36a
36b
42
44
45
46
48

FIG 5
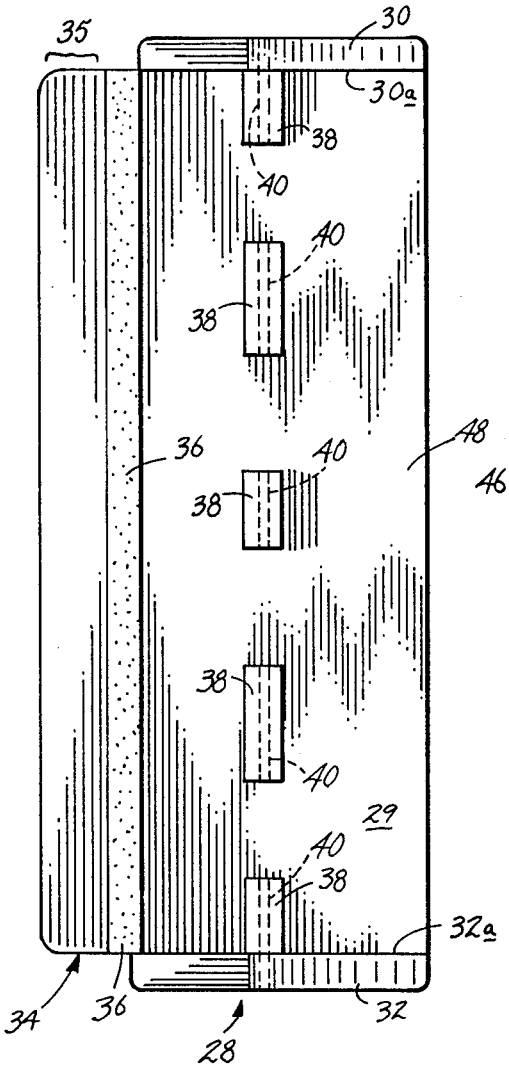
FIG 7
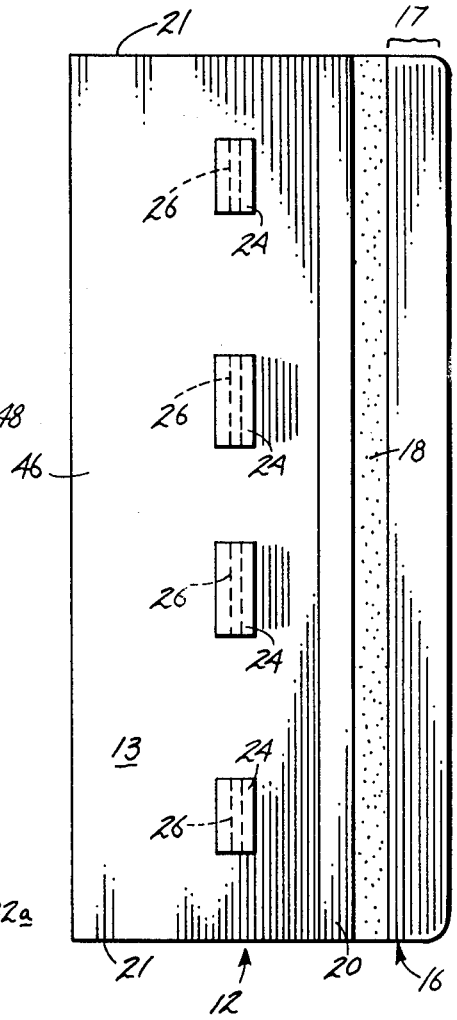
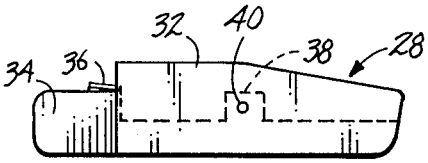
FIG 6
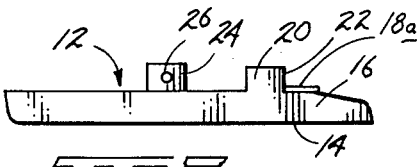
FIG 8

28
56
56d
56b
56a
56c
12
56a
42

56
34
16
28
42
10

56
28
12
42
10

100
112
115
116
117
117a
120
124
128
133
134
135
135a
138
142
144
150
154
156
156b
158
159
171
172

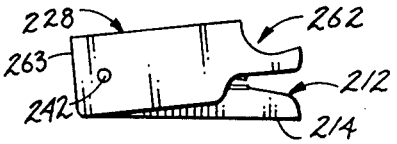
FIG 22
FIG 23
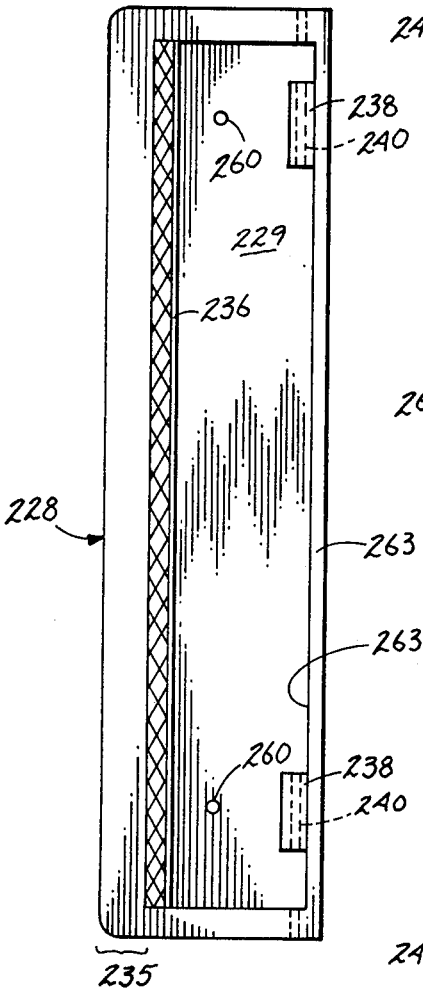
FIG 25
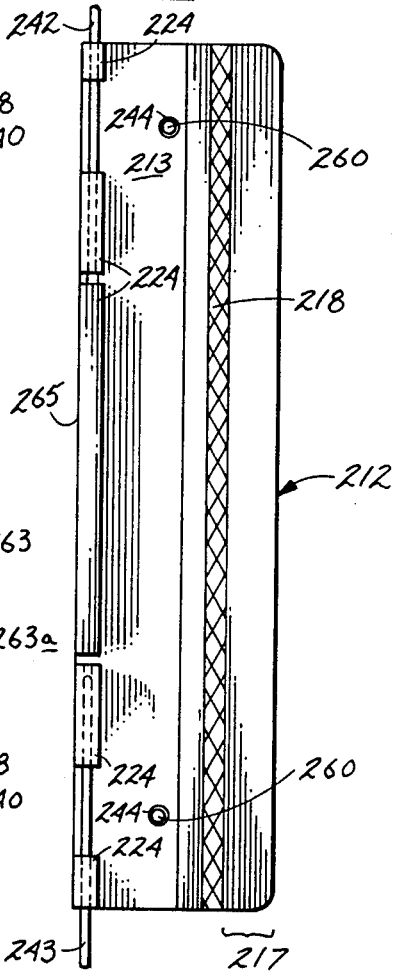
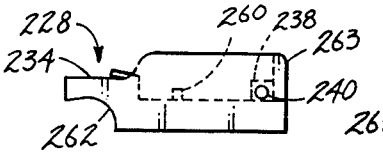
FIG 24
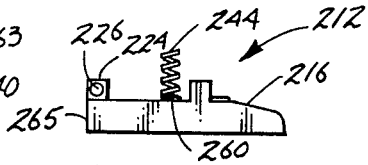
FIG 26

300
328
312
398
342
334
316
29
30
372
370
336
337
328
342
312
372a
391
398
333
315
372b
370b
329
370a
344
393
320
360
313
338
324
365
363

APPARATUS AND METHODS FOR REMOVING MARGIN PORTIONS FROM PERFORATED FLEXIBLE SHEET MATERIALS

TECHNICAL FIELD

This invention relates generally to flexible sheet material such as paper and the removal of perforated or scored margin pieces from the main part of such flexible sheet material.

BACKGROUND OF THE INVENTION

Computer-driven printers commonly use a type of paper referred to as tractor feed printer paper. This type of paper has been perforated along opposing longitudinal edges to provide opposing perforated margin pieces. The margin pieces commonly have aligned and equally spaced tractor feed holes punched therethrough. The holes are sized to receive teeth on drive wheels positioned within the printer for positively feeding and moving paper through the printer as directed by the computer. The paper is generally fed to the printer from a stack of fan-folded sheets and caused to be collected in a stack of fan-folded sheets upon exiting the printer.

It is typically desirable to remove the rather unsightly perforated margin pieces from the main portions of the sheets after they pass through the printer. The paper is generally sized such that the main portions will be of the desired size upon removal of the margin pieces. One presently accepted method of removing margin pieces involves grasping a stack of fan-folded sheets with one hand and manually tearing each of the margin pieces from the stack with the other hand. The remaining margin piece is removed in similar fashion.

The above-described method of removal has several drawbacks. Although perforated to provide a tear line, it is not uncommon when removing the margin pieces to tear the main part of the sheet. This requires that the sheet of material be reprinted. To prevent this, people generally use great care to slowly tear the margins from the main body of the sheet thereby adding significantly to the time needed to remove the margin pieces. The manual method of margin piece removal is an insidious waste of time requiring untold hours of secretarial, management and computer operations staff time without meaningful results.

U.S. Pat. No. 4,529,113 to Elliott shows a "Margin Stripper" which is explained to be useful for removing margin pieces from computer paper. The Elliott device includes a rib on an upper piece which is specifically provided with an outer face for alignment along the perforations of the paper. The force required to securely grip paper using the Elliott invention is greater than desirable and is nonuniform along the length of the device thus leading to uneven tearing, particularly at the starting end. Accordingly, there remains a need for a method and apparatus for enabling margin pieces to be more easily and quickly removed from previously perforated, scored or otherwise prepared sheet material.

BRIEF DESCRIPTION OF THE DRAWINGS

Preferred embodiments of the invention are illustrated in the accompanying drawings, in which:

FIG. 5 is an isolated bottom view of the top portion of the margin piece remover of FIG. 1; the view shows the inside bottom surface;

FIG. 6 is an end view of the top member shown in FIG. 5;

FIG. 7 is an isolated top view of the bottom or base member of the margin piece remover of FIG. 1; the view shows the inside top surface;

FIG. 8 is an end view of the base member of FIG. 7;

FIG. 22 is an end view of the margin piece remover of FIG. 18;

FIG. 23 is a bottom view of the top part of the margin piece remover of FIG. 18 shown in isolation from the base;

FIG. 24 is an end view of the top part shown in FIG. 23;

FIG. 25 is a top view of a bottom part of the margin piece remover of FIG. 18 shown in isolation from the top part;

FIG. 26 is an end view of the bottom part shown in FIG. 25;

DETAILED DESCRIPTION OF THE PREFERRED EMBODIMENT

The following disclosure of the invention is submitted in compliance with the constituted purpose of the Patent Laws "to promote the progress of science and useful arts" (Article 1, Section 8).

Figures 9, 10, 11:
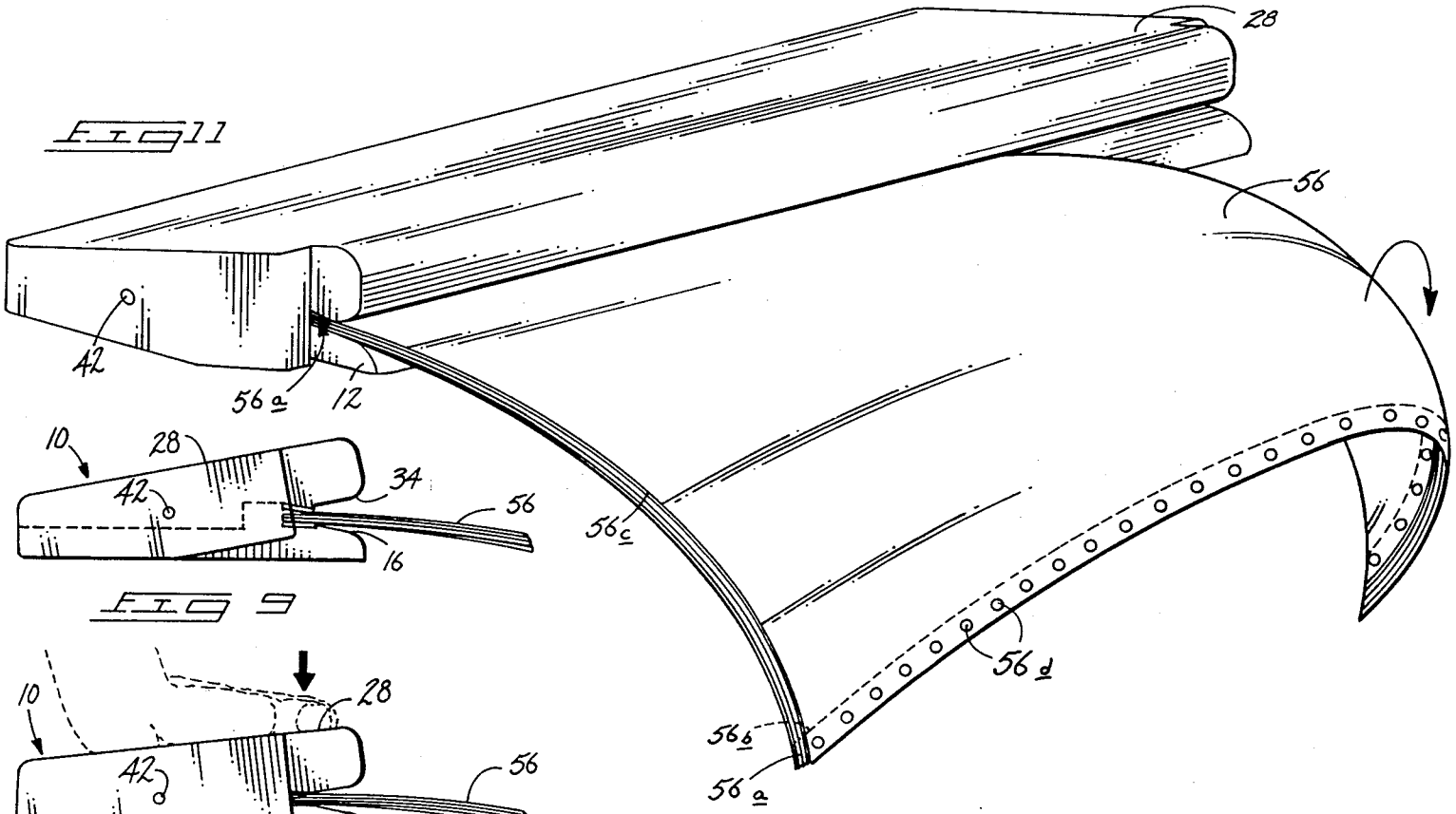
FIG. 9 is an end view of the margin piece remover of FIG. 1, shown in the released or open position with a stack of perforated sheet material positioned therein.
FIG. 10 is an end view similar to FIG. 10 with a hand shown in phantom operating the remover so that the top member is pivoted to grasp the inserted sheets of paper between jaws of the apparatus.
FIG. 11 is a perspective view similar to FIG. 1, with paper sheets inserted thereinto and grasped by jaws of the apparatus.

FIGS. 1–11 show a margin piece remover 10 in accordance with the invention. FIG. 11 shows that margin piece remover 10 is adapted for holding margin pieces or portions 56*a* of paper or other prepared sheet material 56 which have been previously perforated, scored or otherwise prepared for separation from a main part 56*c* of the sheet material as a part line 56*b*.

Margin piece remover 10 includes a top or operative member 28 which is mounted to a base member 12. Base member 12 is advantageously rectangular and includes a lower or bottom exterior surface 14 suitably adapted for bearing against a hard, flat surface such as a table top. As shown bottom surface 14 is planar. Base 12 also includes an interior upper surface or face 13.

Base member 12 further includes a first or lower jaw 16 extending substantially along its length along the front side thereof for receiving one or more margin pieces of a single sheet or stack of sheet material adjacent thereto. Lower jaw 16 includes an engaging or clamping surface 18 which is preferably roughened or textured to provide positive slip-free clamping as will be more fully described below. As shown, roughened clamping surface 18 is provided in the form of an elongate strip of sandpaper 18*a* adhered to and forming a part of base member 12.

Base 12 also includes an elongate, rectangular stop or projection 20 extending upwardly from interior surface 13 along the length of base member 12. Projection 20 serves as a backstop means for stopping and aligning a margin portion of prepared sheet material relative to lower jaw 16 and an opposing upper jaw 34, as will be more fully described below. Stop projection 20 can be of a variety of cross-sectional shapes, which preferably include a stop surface 22 which is advantageously extends upwardly perpendicular to lower jaw contacting face 18. Stop surface 22 extends longitudinally along jaw 16 in aligned parallel relation thereto for enabling a stack of margin pieces of prepared sheet material to be stopped and aligned relative to jaws 16 and 34. Projection 20 is shown extending continuously between opposing end surfaces of base member 12. Alternatively, projection 20 can be in the form of a series of intermittent projections for locating and aligning margin pieces relative to the jaws.

Base 12 further includes a series of upwardly projecting hinge blocks 24 (FIG. 7) extending along its length along a longitudinal pivot axis. Each hinge block 24 includes a longitudinally oriented hole 26. Holes 26 are aligned to define a pivot axis. Holes 26 are adapted for receiving a pivot pin 42 for pivotally connecting base member 12 to the top or operative member 28.

Operative member 28 is generally rectangular and somewhat longer than base member 12, having a pair of laterally projecting end portions 30 and 32. The distance between inner surfaces 30*a* and 32*a* of end portions 30 and 32 is such that end surfaces 21 of base member 12 are positioned therbetween when the base and operative members are connected to one another. This arrangement allows the longitudinal positions of the top and base to easily be maintained.

Operative member 28 includes a second or upper jaw 34 which extends longitudinally along its front side and is adapted for receiving a margin piece of prepared sheet material adjacent thereto. Like lower jaw 16, second jaw 34 preferably includes a roughened clamping surface 36 comprised of, for example, a strip of sandpaper 36*a*, for enabling margin pieces 56*a* (FIG. 11) to be positively and tightly clamped between the jaws.

Figures 1, 2, 3, 4:
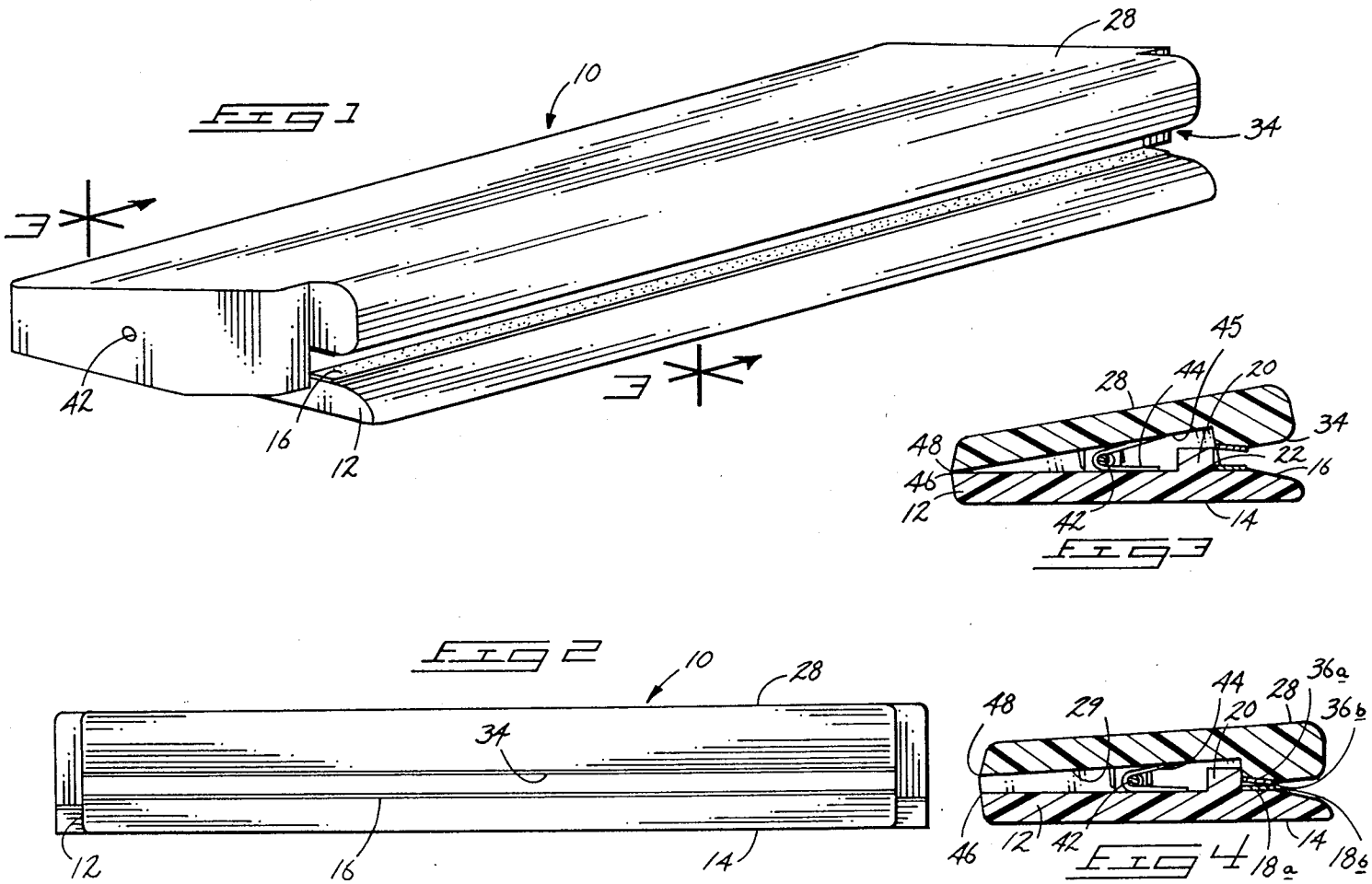
FIG. 1 is a perspective view of a margin piece remover in accordance with the invention.
FIG. 2 is a front view of the margin piece remover of FIG. 1.
FIG. 3 is a sectional view taken along line 3—3 of FIG. 1, showing the margin piece remover in a released or open position.
FIG. 4 is a sectional view similar to FIG. 3 shown in a clamping or closed position.

Upper and lower jaws 16 and 34 preferably are adapted to converge along outer edges 18*b* and 36*b* of the contacting jaw faces 18 and 36, respectively, as most clearly illustrated in FIG. 4. The outer edges 18*b* and 36*b* are preferably spaced from stop surface 22 a distance which causes margin portions 56*a* to be engaged along the tractor feed holes 56*d* (FIG. 11). Tractor feed holes 56*d* are spaced from the perforation line 56*b* along intermediate portions of the margin strips. This arrangement provides superior gripping or pinching action of the paper stack margins with the jaws and surprisingly allows clean separation of the main bodies 56*c* of the sheets from the margin strips 56*a* when retained between the jaws.

Operative member 28 further includes a recessed portion 45 adjacent to jaw 34 for providing space for receiving backstop projection 20 of base member 12, as shown in FIGS. 3 and 4. Recessed portion 45 also allows free travel of backstop 20 when the margin piece remover jaws are closed by pivoting the operative member relative to the base.

Operative member 28 also includes a series of intermittently projecting hinge blocks 38 extending longitudinally along the inside surface 29 of operative member 28. Hinge blocks 38 include longitudinal holes 40 which define a pivot axis and are adapted to receive pivot pin 42 therein. The intermittent positioning of hinge blocks 38 is such that they are staggered and received between hinge blocks 24 of base member 12 when operative member 28 and base member 12 are connected.

FIGS. 1, 3, and 4, show base member 12 and operative member 28 pivotally connected to one another by a pivot pin 42 which extends through holes 26 and 40 of hinge blocks 24 and 38, respectively. In this manner, operative member 38 is pivotally connected to base member 12 for enabling relative pivotal movement between the members about a longitudinal pivot axis defined by pivot pin 42. When so connected, first jaw 16 of base member 12 and second jaw 34 of operative member 28 are positioned in opposing relationship for grasping margin pieces of prepared sheet material between contacting faces 18 and 36. When positioned in an open position, the jaw faces are preferably separated from one another a sufficient distance to enable a stack of sheets to be positioned therebetween. Margin piece remover 10, as shown, can easily receive twenty-five sheets of paper. The height of stop surface 22 is advantageously constructed to be more than the height of the desired stack of sheets being operated upon.

Jaws 16 and 34 preferably include outer lip portions 17 and 35, respectively (FIGS. 5 and 7). Lip portions 17 and 35 converge inwardly from the outer tips thereof toward jaw faces 18 and 36 to aid in the easy and rapid insertion of a stack of sheets thereinto (see FIG. 3).

Margin piece remover 10 also preferably includes biasing means for separating first and second jaws 16 and 34 from one another and into an opened position such as shown in FIG. 3. As shown, margin piece remover 10 includes biasing means in the form of a spring 44 which encircles pivot pin 42 and has two extending arms which bear upon inside surfaces of the operative and base members. One or more springs 44 can be positioned along pivot pin 42 in spaces between hinge blocks 24 and 38 to produce the desired biasing effect about the pivot pin. FIG. 4 illustrates lower jaw 16 and upper jaw 34 in a closed position wherein they are against one another as would occur after overcoming the biasing force of spring 44.

Jaw separation limiting means is also preferably provided for limiting the extent to which first and second jaws 16 and 34 are separated from one another by biasing spring 44. FIGS. 3 and 4 show that the jaw separation limiting means can be included in the form of inside rear edges 48 and 46 of the top and base members 28 and 12, respectively. Inwardly facing rear edges 46 and 48 abut against one another in the resting or open position shown in FIG. 3. The jaw separation of opening limit is preferably structured so that the available height between jaw faces 18 and 36 is less than the height of stop surface 22 to prevent sheets from being inserted over stop 20.

The pivotal connection interconnecting the operative and base members is one example of connecting such members for enabling movement of each relative to the other for bringing the jaws into opposed engaging relationship for grasping margin pieces of sheet material therebetween. Other means for connecting the base and operative members can also be used.

FIGS. 12–17 illustrate a second embodiment margin piece remover 100 in accordance with the invention. Margin piece remover 100 includes a first or base member 112 and an operative or second member 128. First member 112 and second member 128 include first and second jaws 116 and 134, respectively, which are positioned in opposed relationship for engaging and grasping margin pieces of flexible sheet material therebetween. A backstop projection 120 extends longitudinally along first member 112 for stopping and aligning margin pieces between jaws 116 and 134.

Figures 12, 13, 14, 15, 16, 17:
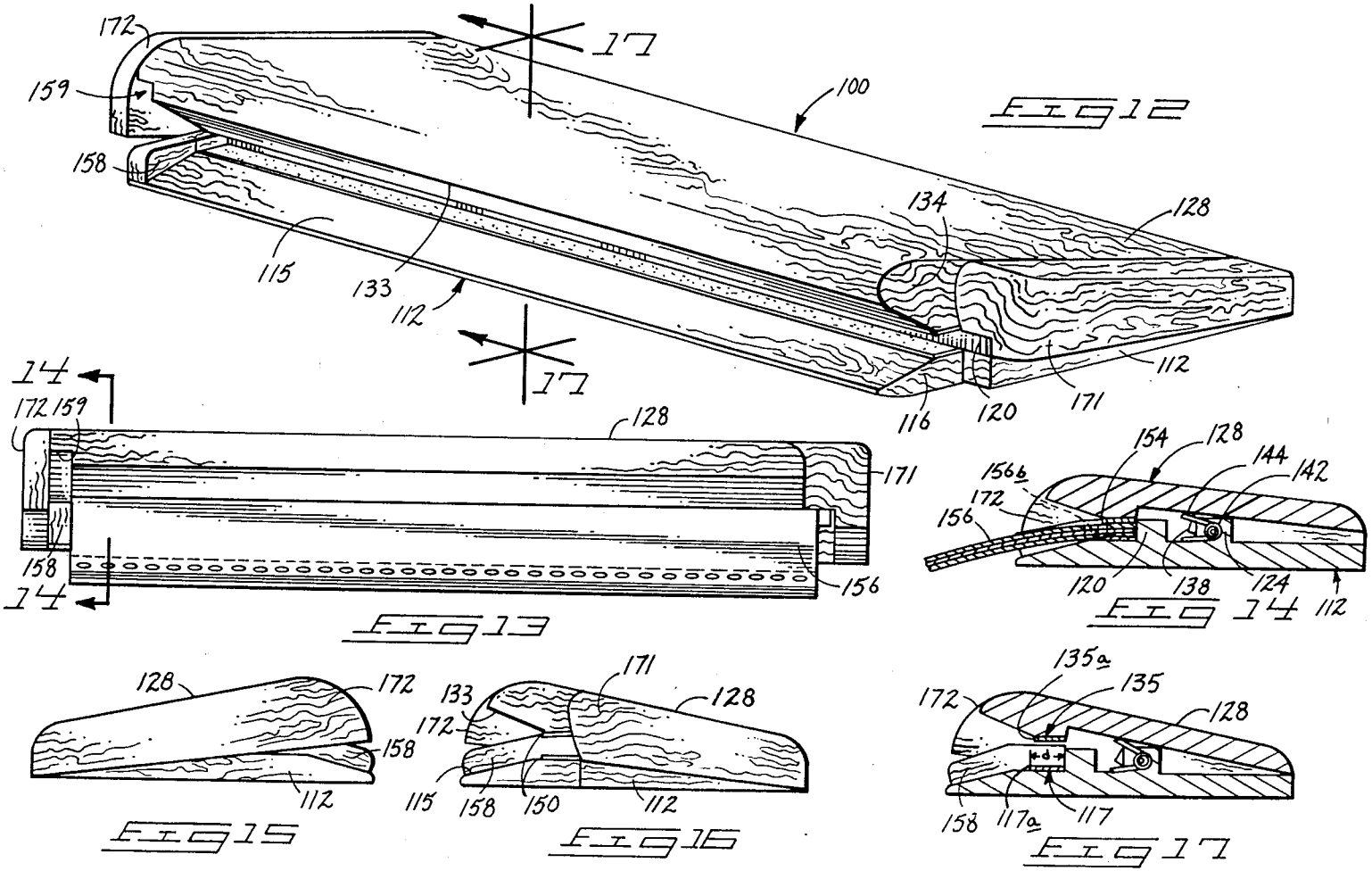
FIG. 12 is a perspective view of an alternative embodiment of margin piece remover in accordance with the invention.
FIG. 13 is a front view of the margin piece remover of FIG. 12 with sheets of paper inserted between the jaws.
FIG. 14 is a sectional view taken along line 14—14 of FIG. 13 showing the stack of paper clamped by the jaws of the margin piece remover.
FIG. 15 is an end view of one end of the margin piece remover of FIG. 12.
FIG. 16 is an end view of the other end of the margin piece remover of FIG. 12.
FIG. 17 is a sectional view similar to FIG. 14 shown in an open position.
Figure 18:
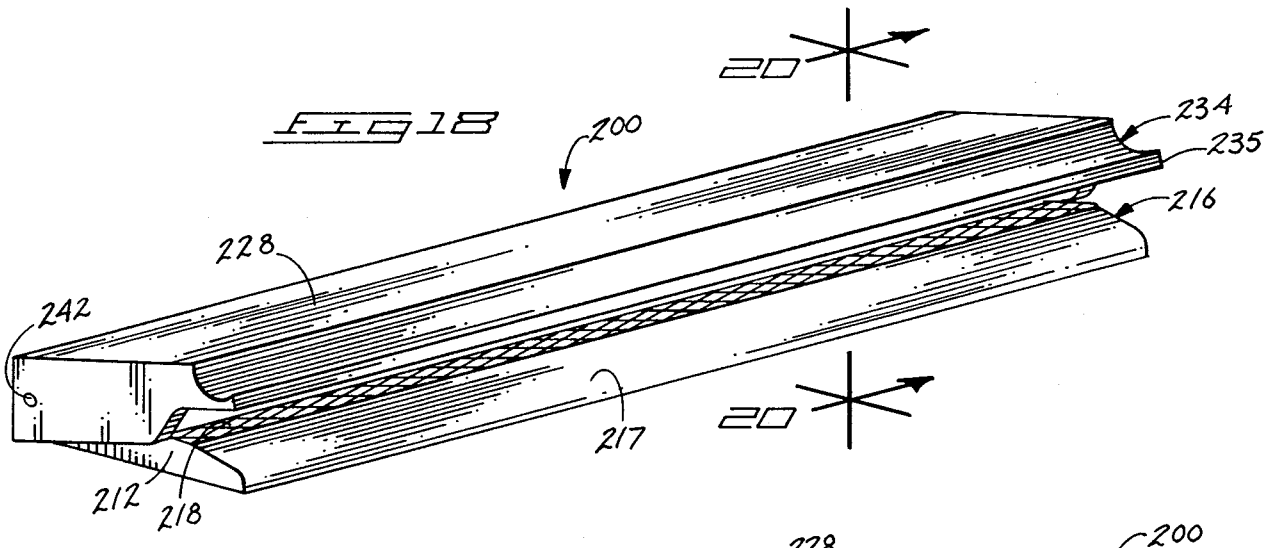
FIG. 18 is a perspective view of yet another embodiment of a margin piece remover in accordance with the invention.
Figure 19:
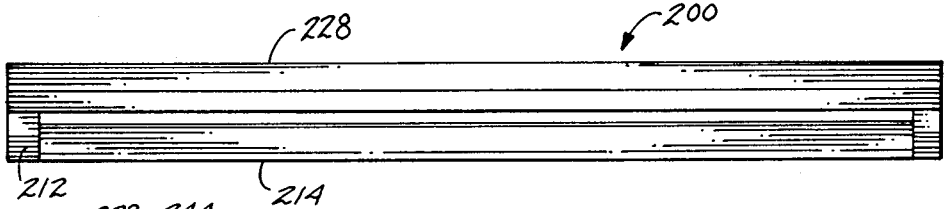
FIG. 19 is a front elevational view of the margin piece remover of FIG. 18.
Figure 21:
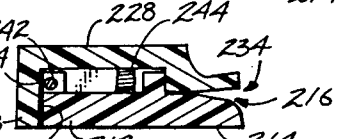
FIG. 21 is a sectional view similar to FIG. 20 with the apparatus shown in a clamping position.

Jaws 116 and 134 have contacting jaw faces 117 and 135 (FIG. 17), all or portions of which serve to contact the opposing sides of the stack of sheet material 156 (FIG. 14). Faces 117 and 135 preferably are provided with a roughed or textured surface to reduce lateral slippage of the margin pieces. The jaw faces further preferably have outer elongate edges **117*a* and 135*a* which meet substantially along a line of jaw face contact when closed or depressed upon the stack of perforated sheets. The jaw faces are advantageously made with a sheet edge receiving depth "d" (FIG. 17) which is substantially narrower than the width of the margin pieces between the extreme outer edge and the perforations 156*b*. This enables the grasping force applied by the jaws to be concentrated over a small lateral area for tightly clamping the margin piece portions. Most preferably, this concentration of grasping force along outer edges 117*a* and 135*a*** is along the tractor drive holes to improve resistance to accidental dislodgment of the stack during margin piece removal.

Jaws 116 and 134 further advantageously include lip portions 115 and 133, respectively. These lip portions create an enlarged vertical space along the open front side of remover 100 for receiving and guiding the stack of sheets being inserted thereinto. The lip portions converge inwardly to closely or smoothly adjoin the contact faces 117 and 135 allowing easy insertion of the margin piece therebetween.

Margin piece remover 100 further includes end stop means for stopping and longitudinally positioning ends of margin portions of the paper relative to the first and second jaws. As shown, the end stop means is in the form of a projection 158 which extends upwardly adjacent an end of first jaw 116. End stop 158 is received within an end stop recess 159 formed along the inside surface of the second member 128 opposite to the end stop. The end stop and backstop allow for easy and rapid positioning of paper or other sheet material by merely inserting the sheets into the corner formed thereby. Remover 100 can be constructed as shown with the end stop at the left end in FIG. 12, or alternatively, it can be constructed as a mirror image thereof with the end stop at the right end.

The first and second members 112 and 128 are adpated for pivotal connection along a centrally located pivot axis using pivot pin 142 (FIG. 14). Pivot extension blocks 124 and 138 (FIGS. 14 and 17), similar to hinge blocks 24 and 38 described above with respect to edger 10, are advantageously included. A biasing spring 144 and jaw separation limiting means formed by the inside rear edges of members 112 and 128 function in the same manner as in edger 10.

Margin piece remover 100 also includes end pieces 171 and 172 attached to and forming a part of top member 128. First end piece 171 is opposite from the end stop 158 and is constructed to allow margin pieces to extend longitudinally thereby when aligned against backstop 120 thus providing a small extension of the margin piece for easy grasping and removal from the jaws. Second end piece 172 extends outwardly adjacent to end stop 158, preferably to an extent approximately the same as the front edges of end stop 158 and lips 115 and 135. Both end pieces are positioned longitudinally outside of end surfaces of base member 112 and serve to longitudinally position the top and base members with respect to each other.

A further embodiment margin piece remover 200 is illustrated in FIGS. 18–26. Margin piece remover 200 is comprised of a first or base member 212 operably connected to a second or top member 228. Members 212 and 228 include jaws 216 and 234, respectively, which engage each other in opposed relationship for grasping margin pieces of sheet material therebetween. Each jaw includes lip portions 217 and 235 which converge inwardly to roughened jaw faces or surfaces 218 and 236. Faces 218 and 236 are integrally formed into a roughened texture by the molded resin forming the respective parts.

A series of intermittent hinge blocks 224 extend longitudinally along the rear edge of first member 212. The spaces between hinge blocks 224 are sized and adapted to receive complementary hinge blocks 238 extending longitudinally near the rear edge of second member 228. A pair of pivot pins 242, 243 extend from outer ends of base member 212 through a longitudinal hole formed through each of hinge blocks 224 and 238. In this manner, a pivot axis is provided adjacent the rear longitudinal edges of first and second members 212 and 228, respectively.

Margin remover 200 also includes biasing means for separating first and second jaws 216 and 234 from one another and is advantageously provided in the form of a pair of coil springs 244 extending between interior surfaces 213 and 229 of first and second members 212 and 228. Each of springs 244 is held in position between the first and second members by a pair of short spring location posts 260 projecting in aligned opposing relationship from the interior surfaces of first and second members 212 and 228.

The outer front edge of second member 228 advantageously includes a rounded longitudinally extending channel portion 262 (see FIG. 22) adapted for receiving a user's fingers or thumb for easier handling during use.

The rear portion of second member 228 includes a longitudinally extending and downwardly projecting rear edge wall 263 adapted and mounted so that the interior side **263*a* abuts a longitudinal rear side edge 265 of first member 212. This abutting relationship provides a bias limiting or jaw separation limiting means for limiting the extent to which the first and second jaws are separated from one another by springs 244 in the extended or open position, best illustrated in FIG. 20. When the first and second members are pivoted to close jaw faces 236 and 218, then the edge wall 263 becomes spaced from rear side edge 265 of first member 212**. See FIG. 21.

Figures 27, 28, 29, 30:
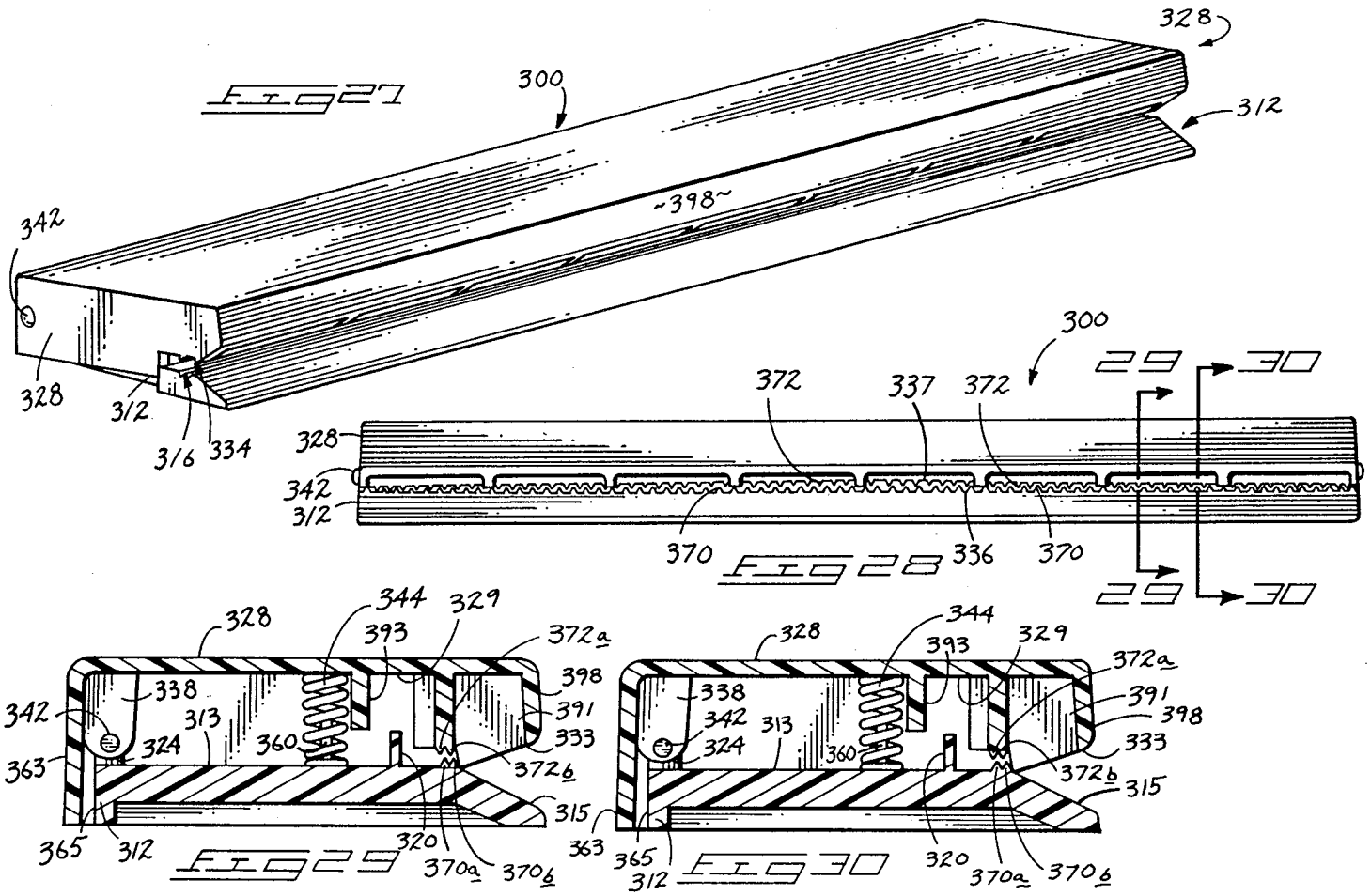
FIG. 27 is a perspective view of still another embodiment of a margin piece remover in accordance with the invention.
FIG. 28 is a front view of the margin piece remover of FIG. 27, the top and base components of the margin piece remover being positioned to contact one another at the jaws.
FIG. 29 is an enlarged sectional view taken along line 29—29 in FIG. 28.
FIG. 30 is an enlarged sectional view taken along line 30—30 in FIG. 28.
Figure 31:
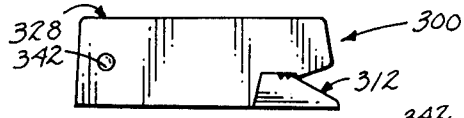
FIG. 31 is an end view of the margin piece remover of FIG. 27 shown as positioned in FIG. 28.
Figure 32:
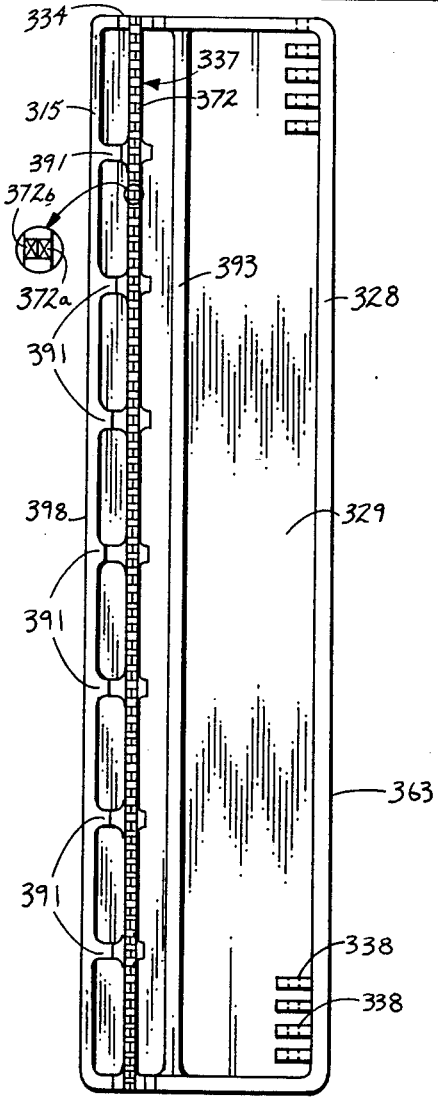
FIG. 32 is a bottom view of the top part of the margin piece remover of FIG. 27 shown in isolation from the top part.
Figure 34:
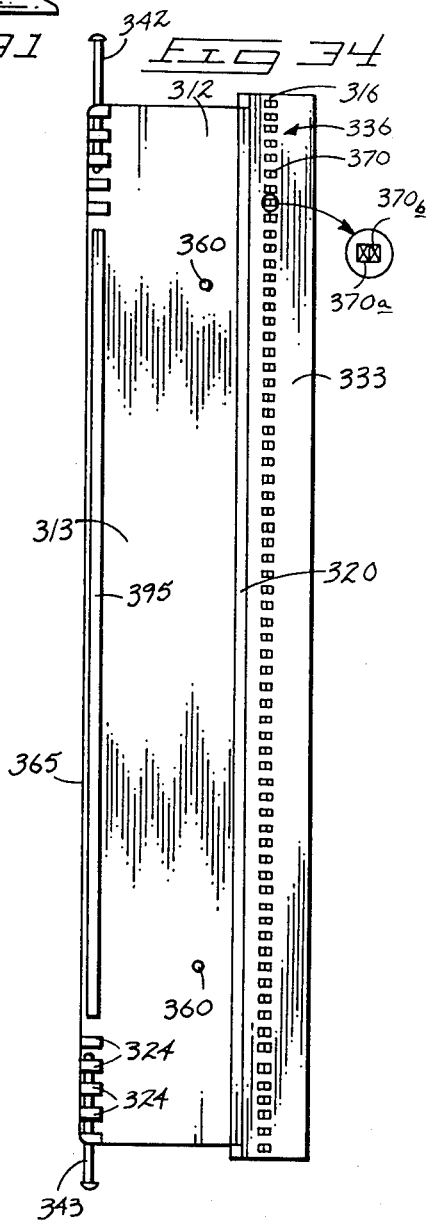
FIG. 34 is a top view of a bottom part of the margin piece remover of FIG. 27 shown in isolation from the top part.
Figure 33:
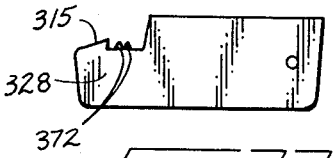
FIG. 33 is an end view of the top part shown in FIG. 32.
Figure 35:
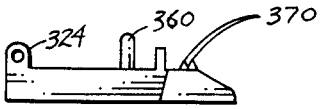
FIG. 35 is an end view of the bottom part shown in FIG. 34.

Still another embodiment of margin portion remover 300 in accordance with the invention is illustrated in FIGS. 27–35. Margin portion remover 300 is comprised of a first or base member 312 operably connected to a second or top member 328. Members 312 and 328 include jaws 316 and 334 respectively, which are in opposed relationship for grasping margin pieces of sheet material between jaw faces 336 and 337, respectively. Jaw faces 336 and 337 each have a plurality of teeth 370 and 372, respectively, which project therefrom. Teeth 370 and 372 extend longitudinally along the length of jaw surfaces 336 and 337, respectively. Each jaw face preferably has a pair of teeth rows having inner teeth **370*a* and outer teeth 370*b* along the lower jaw face and inner teeth 372*a* and outer teeth 372*b* along the upper jaw face (see FIG. 30). The individual sets of inner and outer teeth are longitudinally staggered between the upper and lower sets so that they effectively intermesh as shown in FIG. 28. Additionally, teeth 370 are laterally staggered relative to teeth 372 as shown in FIGS. 29 and 30**. This arrangement enables the teeth to tightly grasp margin pieces of prepared sheet material, preferably along the tractor feed holes.

FIG. 28 further illustrates that the longitudinal elevational profiles of jaws 334 and 336 are arched or bowed relative to each other to provide initial contact at the ends with separation along the middle. As shown upper jaw face 337 is arched substantially along its length relative to lower jaw face 336. The arch in jaw face 337 of upper jaw 334 is advantageously formed to have a separation at the longitudinal center of margin piece remover 300 of approximately 0.050 inch (1 mm). Accordingly, when the jaw portions of top member 328 and bottom member 312 are just brought into contact with one another or a sheet, the outermost ends of the jaw faces initially contact while those at the center remain separated. Additional pressure provided by a user's hand atop the center of upper member 328 will deform the arch bringing the intermediate teeth of the opposing jaw members into engagement. When margin pieces of sheet material are positioned between the jaws and the jaws brought together, pressure is more equally distributed than if the arched relationship is omitted, in which case force is concentrated in the area under the user's hand. The arched construction is also used to provide somewhat greater pressure at the ends which is desirable to more tightly hold the ends of the margin strips which experience more lateral force as the main sheet is initially torn away from the margin strips held in the jaws.

Jaws 316 and 334 further include outwardly extending lip portions 315 and 333, respectively. These lip portions create an enlarged vertical space along the open front side of remover 300 for receiving and guiding a stack of sheets being inserted thereinto. Lower lip portion 315 converges upwardly and inwardly to join the outermost row of lower teeth **370*b* near the base of such teeth. Upper lip 333 is formed to include a plurality of upper lip guides 391 which extend inwardly from outer face piece 398. Upper lip guides 391 project downwardly in an inwardly converging arrangement. The inner edges of upper lip guides 391 advantageously project downwardly to a point below teeth 372** to prevent the stack of sheets from catching thereon when inserted between the jaws in a fully open position determined by the jaw separation limiting means described below.

Top member 328 also advantageously includes an overshoot barrier 393 which projects downwardly from the inner surface of operative member 328. As shown, overshot barrier 393 extends longitudinally along the full length thereof. When remover 300 is positioned in the open receiving position shown in FIG. 27, the overshoot barrier 393 and backstop 320 cooperate to help prevent sheets from being inserted over backstop 320 and getting caught within remover 300 in misaligned or over-inserted positions.

Bottom member 312 includes a plurality of hinge blocks 324 arranged into series near each end. The series of hinge blocks 324 extend longitudinally along the outer ends near the rear edge of first member 312. A stiffening rib 395 advantageously extends between the series of hinge blocks. The spaces between hinge blocks 324 are sized and adapted to receive complementary hinge blocks 338 which are appropriately spaced at longitudinal positions near the rear edge of second member 328. A pair of pivot pins 342 and 343 extend through longitudinal holes formed through each of hinge blocks 324 and 338 in an aligned arrangement. In this manner, a pivot axis is provided adjacent the rear longitudinal edges of first and second members 312 and 328.

Margin piece remover 300 also includes biasing means for separating first and second jaws 316 and 334 from one another. The biasing means is provided in the form of a pair of coil springs 344 extending between interior surfaces 313 and 329 of first and second members 312 and 328, respectively. Each of springs 344 is held in position between the first and second members by short spring locating posts 360 projecting upwardly from interior surface 313 of first member 312.

Figure 20:
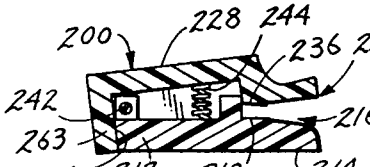
FIG. 20 is a sectional view taken along line 20—20 in FIG. 18.

The rear portion of second member 328 includes a longitudinally extending and downwardly projecting rear edge wall 363 adapted to abut a longitudinal rear side edge 365 of first member 312. This abutting relationship provides a jaw separation limiting means for limiting the extent to which the first and second jaws are separated from one another by springs 344. The separation is limited to a predetermined height when in a fully extended position, such as shown in FIG. 20 with respect to another embodiment. When the first and second members are pivoted to close jaws 334 and 316, then the edge wall 363 becomes spaced from rear side edge 365 of first member 312, as shown in FIG. 29.

Reference should now be made to FIGS. 9–11 for a description of novel methods for removing margin portions from main portions of perforated or otherwise prepared sheet material. Similar procedures are used with other edges according to this invention. FIG. 9 illustrates margin piece remover 10 being used to aid in the removal of such margin portions. To use margin remover 10, a person positions a margin portion **56*a* of sheet material 56 against backstop 20 to align the margin portion between the opposing pair of elongate jaws 16 and 34 such that the jaws extend along most or all of the length of the margin piece. Pressure is then applied by a user's hand to clamp the jaws and grasp the margin pieces along at least portions of the margin pieces, see FIG. 10**. With a stack of margin pieces so clamped, a person can then tear the main part of the stack of paper or other material from the margin portions by applying an outward pressure, preferably while simultaneously pulling the flexible sheet upwardly or downwardly. Such provides a fast and convenient way to simultaneously remove a number of perforated margin portions from the prepared sheets of paper or other prepared flexible sheet material.

After the main part **56*c*** has been separated from the clamped margin pieces, then it is possible to remove the margin pieces from the jaws by manually extracting or tipping the unit on end. To assist in removal of the margin piece it is preferable that the overall length of the jaws be somewhat less than the length of the paper. This allows the user to easily grasp the stack of separated margin pieces and withdraw them from between the jaws for proper disposal.

The various apparatus according to this invention can be constructed of any suitable material. Margin piece removers 10, 200, and 300 are shown constructed of plastic, which advantageously can be molded or otherwise formed as indicated. Margin piece remover 100 is shown constructed of wood and can be manufactured using ordinary woodworking techniques. In margin remover 100, end pieces 171 and 172 are preferably attached after the pivot pin is inserted to cover the pivot pin holes from view. A variety of other materials and methods of construction can also be used.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An apparatus for holding margin portions of paper or other flexible sheet material which have been previously perforated, scored or otherwise prepared for separation from a main part of the sheet material, the apparatus comprising:

a base member having a first elongated jaw extending longitudinally along the base member for receiving margin portions of prepared sheet material adjacent thereto;

an operative member connected to the base member and having a second elongated jaw extending longitudinally along the operative member in opposing relationship relative to the first elongated jaw, the operative and base members including means for enabling the first and second elongated jaws to be controllably moved between open positions and engaging positions for grasping margin portions of prepared sheet material therebetween;

said first and second elongated jaws each including a contacting jaw face, and a lip portion extending outwardly relative to each jaw face for contacting and guiding sheet material into position between the jaws;

backstop means extending longitudinally along at least a portion of one of said members adjacent at least one of said elongated jaws for stopping and aligning margin portions of prepared sheet material between the first and second elongated jaws for grasping thereby; and separation limiting means for limiting separation between the first and second elongated jaws to a predetermined separation height in a fully open position.

2. The apparatus of claim 1 wherein the operative member is pivotally connected to the base member along a centrally located axis extending longitudinally along both of said members.

3. The apparatus of claim 2 wherein the separation limiting means comprises:

the operative and base members including interior and opposing rear edge portions, the interior rear edge portions engaging one another for limiting the separation of the first and second elongated jaws from one another.

4. The apparatus of claim 1 wherein each jaw includes a contacting jaw face having an outer elongated edge, the first and second jaws being constructed to engage each other along their respective outer elongated edges along approximately a line of contact.

5. The apparatus of claim 3 wherein said line of contact is spaced from the backstop means sufficiently far so that prepared sheet material positioned thereagainst is engaged along a series of tractor feed holes formed in the margin portions.

6. The apparatus of claim 1 wherein the lip portions converged inwardly relative to one another toward the contacting jaw faces.

7. The apparatus of claim 1 wherein lip portions project to a sufficient extent so as to guide sheet material past teeth formed on at least one jaw face.

8. The apparatus of claim 1 wherein at least one of the first and second jaws is longitudinally arched relative to the other jaw.

9. The apparatus of claim 1 further comprising end stop means for stopping and longitudinally positioning an end of a flexible sheet material relative to the first and second elongated jaws.

10. The apparatus of claim 1 further comprising biasing means for biasing said jaws into a fully open position.

11. The apparatus of claim 1 wherein the jaws include contacting jaw faces with roughened surfaces for clamping margin portions therebetween.

12. The apparatus of claim 11 wherein the jaws include contacting jaw faces at least one of which is provided with teeth.

13. The apparatus of claim 1 wherein each of the first and second elongated jaws includes a plurality of projecting teeth, the teeth of each jaw being longitudinally staggered relative to the teeth of the other jaw enabling the teeth to be brought into interengaging relationship with respect to one another.

14. The apparatus of claim 13 wherein each of the first and second elongated jaws includes a plurality of rows containing a plurality of projecting teeth, the rows of the first jaw being laterally staggered relative to the rows of the second jaw.

15. The apparatus of claim 13 wherein at least one of the first and second jaws is longitudinally arched relative to the other jaw.

16. The apparatus of claim 1 wherein the separation limiting means comprises:

the operative member being pivotally connected to the base member adjacent rear longitudinal edges of said members; the rear longitudinal edge of the operative member including a downwardly projecting rear edge wall and the base member including a longitudinal rear side edge, the downwardly projecting rear edge wall engaging the rear side edge for limiting separation of the first and second jaws from one another.

17. A method of removing margin portions from paper or other prepared flexible sheet material which have been previously perforated, scored, or otherwise prepared for separation from a main part of the sheet material, the method comprising:

guiding a margin portion of sheet material between converging lip portions of a pair of elongate opposing jaws;

positioning the margin portion of the sheet material against a backstop for aligning said margin portions between the pair of elongate opposing jaws having jaw faces extending along said margin portion;

grasping said margin portion with the pair of jaws substantially along the length of said margin portion, the outside edges of the jaw faces engaging along a line of contact, the jaw faces being positioned such that the line of contact engages the margin portion intermediate between perforations or other preparations for separation and an outer edge; and tearing said main part of the sheet material from said margin portion while the margin portion is grasped by said jaws.

18. The method of claim 17 wherein grasping occurs along the line of contact at a series of tractor feed holes formed in the margin portion.

19. The method of claim 18 wherein the guiding step is further defined by guiding the margin portion of the sheet material relative to jaw teeth using at least one lip guide which assists the sheet material to become positioned against the backstop with minimal catching of the sheet material by the jaw teeth.

20. An apparatus for holding margin portions of paper or other flexible sheet material which have been previously perforated, scored or otherwise prepared for separation from a main part of the sheet material, the apparatus comprising:

a base member having a first elongated jaw extending longitudinally along the base member for receiving margin portions of prepared sheet material adjacent thereto;

an operative member connected to the base member and having a second elongated jaw extending longitudinally along the operative member in opposing relationship relative to the first elongated jaw, the operative and base members including means enabling the first and second elongated jaws to be brought into opposed engaging relationship for grasping margin portions of prepared sheet material therebetween;

backstop means extending longitudinally along at least a portion of one of said members adjacent the respective first or second elongated jaw for stopping and aligning a margin portion of prepared sheet material between the first and second elongated jaws for grasping thereby; and each jaw including a contacting jaw face, and a lip portion extending outwardly relative to each jaw face for contacting the sheet material to guide it into position between the jaws.

21. The apparatus of claim 20 wherein the lip portions converge inwardly relative to one another toward the contacting jaw faces.

22. An apparatus for holding margin portions of paper or other flexible sheet material which have been previously perforated, scored or otherwise prepared for separation from a main part of the sheet material, the apparatus comprising:

a base member having a first elongated jaw extending longitudinally along the base member for receiving margin portions of prepared sheet material adjacent thereto;

an operative member connected to the base member and having a second elongated jaw extending longitudinally along the operative member in opposing relationship relative to the first elongated jaw, the operative and base members including means enabling the first and second elongated jaws to be brought into opposed engaging relationship for grasping margin portions of prepared sheet material therebetween;

said jaws including outwardly extending lip portions which converge inwardly for contacting and guiding the sheet material into position between the jaws;

backstop means extending longitudinally along at least a portion of one of said members adjacent the respective first or second elongated jaw for stopping and aligning a margin portion of prepared sheet material between the first and second elongated jaws for grasping thereby; and at least one of the first and second jaws being longitudinally arched relative to the other jaw.

23. The apparatus of claim 22 wherein each of the first and second elongated jaws includes a plurality of projecting teeth, the teeth of each jaw being longitudinally staggered relative to the teeth of the other jaw enabling the teeth to be brought into interengaging relationship with respect to one another.

24. The apparatus of claim 23 wherein each of the first and second elongated jaws includes a plurality of rows containing a plurality of projecting teeth, the rows of the first jaw being laterally staggered relative to the rows of the second jaw.

25. The apparatus of claim 22 wherein each of the first and second elongated jaws includes a plurality of rows containing a plurality of projecting teeth, the rows of the first jaw being laterally staggered relative to the rows of the second jaw.

26. The apparatus of claim 22 wherein at least one of said jaws includes a lip portion having at least one lip guide which projects at least partially past a plurality of teeth projecting from the jaw provided with the lip guide.

27. The apparatus of claim 22 wherein the lip portion of the second jaw includes at least one guide which projects from the operative member at least partially past a plurality of teeth projecting from the jaw for preventing the prepared sheet material from catching upon the teeth of the second jaw when inserted between said jaws.

28. An apparatus for holding margin portions of paper or other flexible sheet material which have been previously perforated, scored or otherwise prepared for separation from a main part of the sheet material, the apparatus comprising:

a base member having a first elongated jaw extending longitudinally along the base member for receiving margin portions of prepared sheet material adjacent thereto;

an operative member connected to the base member and having a second elongated jaw extending longitudinally along the operative member in opposing relationship relative to the first elongated jaw; each of said jaws including a contacting jaw face having an outer edge;

said first and second elongated jaws each including a contacting jaw face, and a lip portion extending outwardly relative to each jaw face for contacting and guiding sheet material into position between the jaws;

the operative and base members including means enabling the first and second elongated jaws to be brought into opposed engaging relationship along said outer edges along approximately a line of contact for grasping margins of prepared sheet material therebetween; and backstop means extending longitudinally along at least a portion of one of said members adjacent the respective first or second elongated jaw for stopping and aligning a margin piece of prepared sheet material between the first and second elongated jaws for grasping thereby.

29. The apparatus of claim 28 wherein said line of contact is spaced from the backstop means sufficiently far so that prepared sheet material positioned thereagainst is engaged along a series of tractor feed holes formed in the margin portions.

30. An apparatus for holding margin portions of paper or other flexible sheet material which have been previously perforated, scored or otherwise prepared for separation from a main part of the sheet material, the apparatus comprising:

a base member having a first elongated jaw extending longitudinally along the base member for receiving margin portions of prepared sheet material adjacent thereto;

an operative member connected to the base member and having a second elongated jaw extending longitudinally along the operative member in opposing relationship relative to the first elongated jaw, the operative and base members including means for enabling the first and second elongated jaws to be controllably moved between the open positions and engaging positions for grasping margin portions of prepared sheet material therebetween;

said first and second elongated jaws each including a contacting jaw face, and a lip portion extending outwardly relative to each jaw face for contacting and guiding sheet material into position between the jaws;

backstop means extending longitudinally along at least a portion of one of said members adjacent at least one of said elongated jaws for stopping and aligning margin portions of prepared sheet material between the first and second elongated jaws for grasping thereby; and biasing means for biasing the jaws into an open position.

31. The apparatus of claim 30 wherein the operative member is pivotally connected to the base member along a centrally located axis extending longitudinally along both of said members.

32. The apparatus of claim 30 wherein each jaw includes a contacting jaw face having an outer elongated edge, the first and second jaws being constructed to engage each other along their respective outer elongated edges along approximately a line of contact.

33. The apparatus of claim 32 wherein said line of contact is spaced from the backstop means sufficiently far so that prepared sheet material positioned thereagainst is engaged along a series of tractor feed holes formed in the margin portions.

34. The apparatus of claim 30 wherein the lip portions converge inwardly relative to one another toward the contacting jaw faces.

35. The apparatus of claim 30 wherein at least one of the lip portions project to a sufficient extent so as to guide sheet material past teeth formed on at least one jaw face.

36. The apparatus of claim 30 wherein at least one of the first and second jaws is longitudinally arched relative to the other jaw.

37. The apparatus of claim 30 further comprising end stop means for stopping and longitudinally positioning an end of a flexible sheet material relative to the first and second elongated jaws.

38. The apparatus of claim 37 wherein there is one end stop means at first ends of the elongated jaws and the opposite second ends of the elongate jaws are open to allow sheet material to extend therefrom while positioned against said backstop means.

39. The apparatus of claim 30 wherein the jaws include contacting jaw faces with roughened surfaces for clamping margin portions therebetween.

40. The apparatus of claim 39 wherein the jaws include contacting jaw faces at least one of which is provided with teeth.

41. The apparatus of claim 30 wherein each of the first and second elongated jaws includes a plurality of projecting teeth, the teeth of each jaw being longitudinally staggered relative to the teeth of the other jaw enabling the teeth to be brought into interengaging relationship with respect to one another.

42. The apparatus of claim 41 wherein each of the first and second elongated jaws includes a plurality of rows containing a plurality of projecting teeth, the rows of the first jaw being laterally staggered relative to the rows of the second jaw.

43. The apparatus of claim 41 wherein at least one of the first and second jaws is longitudinally arched relative to the other jaw.

44. The apparatus of claim 30 further comprising separation limiting means for limiting separation between the first and second elongated jaws to a predetermined separation height in a fully open position.

45. The apparatus of claim 44 wherein the separation limiting means comprises:

the operative member being pivotally connected to the base member adjacent rear longitudinal edges of said members; the rear longitudinal edge of the operative member including a downwardly projecting rear edge wall and the base member including a longitudinal rear side edge, the downwardly projecting rear edge wall engaging the rear side edge for limiting separation of the first and second jaws from one another.

* * * * *